US007768184B2

(12) United States Patent
Hanashi et al.

(10) Patent No.: US 7,768,184 B2
(45) Date of Patent: Aug. 3, 2010

(54) SPARK PLUG WITH STREAM SHAPER TO SHAPE TUMBLE VORTEX INTO DESIRED STREAM IN COMBUSTION CHAMBER

(75) Inventors: Ken Hanashi, Handa (JP); Takayuki Takeuchi, Aichi-ken (JP)

(73) Assignees: Denso Corporation, Aichi-Pref., Kariya (JP); Nippon Soken, Inc., Aichi-Pref., Nishio (JP)

( * ) Notice: Subject to any disclaimer, the term of this patent is extended or adjusted under 35 U.S.C. 154(b) by 272 days.

(21) Appl. No.: 11/923,066

(22) Filed: Oct. 24, 2007

(65) Prior Publication Data

US 2008/0092839 A1 Apr. 24, 2008

(30) Foreign Application Priority Data

Oct. 24, 2006 (JP) ..... 2006-288200

(51) Int. Cl.
*H01T 13/20* (2006.01)

(52) U.S. Cl. ..... 313/143

(58) Field of Classification Search ..... 313/118–145; 123/169 R, 260, 262; 445/7
See application file for complete search history.

(56) References Cited

U.S. PATENT DOCUMENTS

| | | | |
|---|---|---|---|
| 5,144,188 A | 9/1992 | Kagawa et al. | |
| 5,799,637 A | 9/1998 | Cifuni | |
| 6,078,129 A | 6/2000 | Gotou et al. | |
| 6,094,000 A | 7/2000 | Osamura et al. | |
| 6,262,522 B1 | 7/2001 | Osamura et al. | |
| 6,846,214 B1 | 1/2005 | Gotou et al. | |
| 7,007,653 B2 * | 3/2006 | Labarge et al. | 123/169 EL |
| 2007/0052336 A1 * | 3/2007 | Liao | 313/141 |

FOREIGN PATENT DOCUMENTS

| | | |
|---|---|---|
| JP | 4-4583 | 1/1992 |
| JP | 9-007733 | 1/1997 |
| JP | H11-003765 | 1/1999 |
| JP | 2005-63705 | 3/2005 |

OTHER PUBLICATIONS

U.S. Appl. No. 11/877,913, filed Oct. 2007, Takeuchi et al.
U.S. Appl. No. 11/976,438, filed Oct. 2007, Kenichiro et al.

* cited by examiner

*Primary Examiner*—Joseph L Williams
*Assistant Examiner*—Andrew J Coughlin
(74) *Attorney, Agent, or Firm*—Nixon & Vanderhye PC

(57) ABSTRACT

A spark plug for an internal combustion engine is provided which includes a hollow cylindrical metal shell with an open end portion to be exposed to a combustion chamber of the engine, a ground electrode joined to the metal shell, a center electrode disposed in the metal housing to define a spark gap between itself and the ground electrode. The spark plug also includes a stream shaper geometrically formed on an outer periphery of the open end portion of the metal shell to shape tumble vortexes of air-fuel mixture into vortex streams oriented toward a central portion of the combustion chamber. This ensures the stability of orientation of the tumble vortexes to control a flow of sparks, thereby enhancing the ignitability of the air-fuel mixture in the combustion chamber.

8 Claims, 6 Drawing Sheets

SPARK PLUG WITH STREAM SHAPER TO SHAPE TUMBLE VORTEX INTO DESIRED STREAM IN COMBUSTION CHAMBER

CROSS REFERENCE TO RELATED DOCUMENT

The present application claims the benefit of Japanese Patent Application No. 2006-288200 filed on Oct. 24, 2006, the disclosure of which is incorporated herein by reference.

This application is also related to copending, commonly assigned and filed U.S. application Ser. Nos. 11/877,913 and 11/976,438.

BACKGROUND OF THE INVENTION

1. Technical Field of the Invention

The present invention relates generally to a spark plug for internal combustion engines such as automotive gasoline engines, and more particularly to an improved structure of such a spark plug equipped with a stream shaper working to shape tumble vortexes into streams oriented inside a combustion chamber of the engine to enhance the ignitability of air-fuel mixture.

2. Background Art

There have been proposed various types of spark plugs designed to have improved structures and materials of a center electrode and/or a ground electrode for enhancing the ignitability of air-fuel mixture within a combustion chamber of the engine. For example, Japanese Patent First Publication No. 2005-63705 teaches geometrical configuration and material of the center electrode of the spark plug for improving the heat-resistance and wear-resistance thereof.

In typical internal combustion engines, streams of air-fuel mixture flowing through parts of the spark plug such as the center electrode and the ground electrode exposed to a combustion chamber of the engine are usually disturbed by tumble vortexes of the air-fuel mixture, thus resulting in the instability in creating a sequence of sparks between the center and ground electrodes. In recent years, internal combustion engines have appeared in which the configuration of intake ports or piston heads are modified in order to enhance the power output from the engine, so that the speed of streams of the air-fuel mixture is increased, thus resulting in increased dispersion of the tumble vortexes. This leads to instability of size or orientation of the sparks. The flame of the mixture, as created in the combustion chamber, may be undesirably cooled or dispersed depending upon the orientation of a flow of the spark, thus resulting in undesired form of the flame which contributes to poor ignition of the mixture. The structure of the spark plug, as taught in the above publication, has the same problem, as described above.

SUMMARY OF THE INVENTION

It is therefore a principal object of the invention to avoid the disadvantages of the prior art.

It is another object of the invention to provide a spark plug for internal combustion engines such as automotive gasoline engines which is designed to shape tumble vortexes of air-fuel mixture into streams oriented to a central portion of a combustion chamber of the engine, thereby ensuring the stability of flow of sparks to enhance the ignitability of the mixture.

According to one aspect of the invention, there is provided a spark plug which may be employed in automotive gasoline engines. The spark plug comprises: (a) a hollow cylindrical metal housing which has an open top end portion to be exposed to a combustion chamber of an internal combustion engine; (b) a ground electrode joined to the metal housing; (c) a center electrode disposed in the metal housing to define a spark gap between itself and the ground electrode; (d) a porcelain insulator disposed in the metal housing to electrically insulate between the metal housing and the center electrode; and (e) a stream shaper geometrically formed on an outer periphery of the top end portion of the metal housing to shape tumble vortexes of air-fuel mixture into vortex streams oriented toward a central portion of the combustion chamber. This ensures the stability of orientation of the tumble vortexes to control a flow of sparks, thereby enhancing the ignitability of the air-fuel mixture in the combustion chamber. The stream shaper is useful in low fuel ignitability conditions such as lean burning.

In the preferred mode of the invention, the porcelain insulator has a nose protruding from a top surface of the top end portion of the metal shell. The vortex streams, as created by the stream shaper, pass around an outer circumference of the nose of the porcelain insulator, thus enhancing the shaping of the vortex streams.

The stream shaper may be defined by a portion of the outer periphery of the metal housing. The portion continues to a top surface of the top end portion and being slant to a longitudinal center line of the metal housing to have an outer diameter of the top end portion of the metal housing decreasing toward the top surface of the top end portion. Specifically, the inclination of the top surface serves to enhance the orientation of the vortex streams.

The angle θ which a line tangent to the slant portion of the outer periphery of the metal housing at an intersection with the top surface of the top end portion of the metal housing makes with a plane, as defined to extend over the top surface of the top end portion, is selected to lie in a range of 10° to 60°. This enhances the orientation of the vortex streams.

The slant portion of the outer periphery of the metal housing may be so shaped that the line tangent to the slant portion passes through the spark gap, thereby optimizing a flow of sparks to enhance the ignitability of the air-fuel mixture in the combustion chamber.

The slant portion of the outer periphery of the top end portion defining the stream shaper may have a width W2 in a lateral direction perpendicular to the longitudinal center line of the metal housing which is 0.5 mm or more. A ratio of the width W2 to a width W1 of the top surface of the top end portion in the lateral direction (W2/W1) is in a range of 0.5 to 1.0. This ensures the size of the slant portion which is great enough to orient the vortex streams to the central portion of the combustion chamber.

The slant portion of the outer periphery of the metal housing defining the stream shaper may alternatively have formed at least partially thereon a tapered surface along which the outer diameter of the top end portion decreases toward the top surface.

The slant portion of the outer periphery of the metal housing defining the stream shaper may also have at least one stepwise shoulder surface formed thereon so that the outer diameter of the top end portion decreases stepwise toward the top surface.

The slant portion of the outer periphery of the metal housing defining the stream shaper may also include a curved surface.

The slant portion of the outer periphery of the metal housing defining the stream shaper may alternatively include a surface which is so curved that a rate at which the inner diameter of the top end portion decreases toward the top surface of the top end portion decreases toward the top surface.

The slant portion of the outer periphery of the metal housing defining the stream shaper may alternatively include a surface which is so curved that a rate at which the inner diameter of the top end portion decreases toward the top surface of the top end portion increases toward the top surface.

The stream shaper may be formed to occupy 50% or more of the top end portion of the metal housing.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 8:
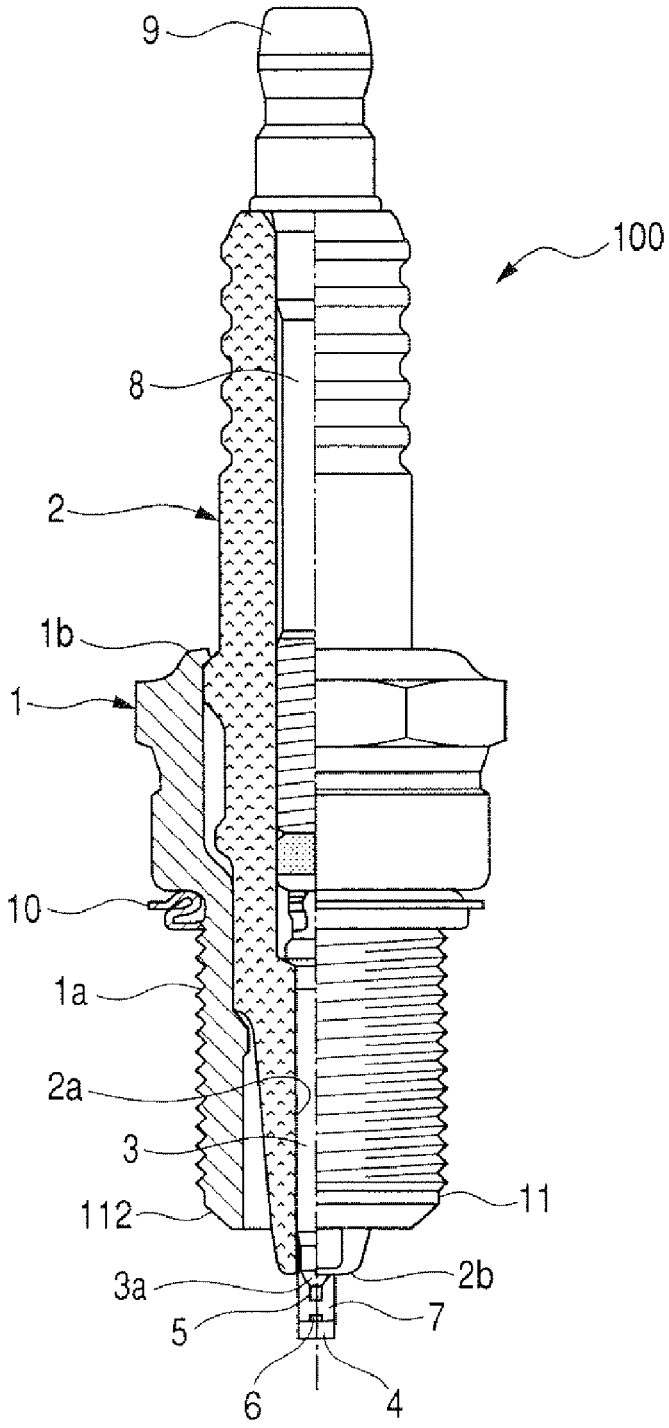
FIG. 8 is a partially sectional view which shows the spark plug of FIG. 1.

Referring to the drawings, wherein like reference numbers refer to like parts in several views, particularly to FIG. 8, there is shown a spark plug 100 which may be used in internal combustion gasoline engines for automotive vehicles.

The spark plug 100 includes a cylindrical metal housing or shell 1, a porcelain insulator 2, a center electrode 3, and ground electrode 4.

The metal shell 1 is made of a hollow metallic cylinder and has cut therein a thread 1*a* for mounting the spark plug 100 in an engine block (not shown).

The porcelain insulator 2 made of an electrically insulating material such as alumina is retained coaxially within the metal shell 1. The metal shell 1 has an upper annular extension 1*b* crimped inwardly to hold the porcelain insulator 2 firmly therewithin. The center electrode 3 to which a high voltage is to be applied is fit in a center through hole 2*a* of the porcelain insulator 2. In other words, the center electrode 3 is disposed in the metal shell 1. The porcelain insulator 2 is placed between the metal shell 1 and the center electrode 3.

The center electrode 3 is made of a heat-resistant base material such as nickel alloy and has a tip 3*a* extending outside a top surface 2*b* of the porcelain insulator 2. The ground electrode 4 is of an L-shape and extends from a top end 11 of the metal shell 1 so that it faces the tip 3*a* of the center electrode 3. The ground electrode 4 is, like the center electrode 3, made of a heat-resistant base material such as nickel alloy.

The center electrode 3 has a noble metal chip 5 welded to the tip 3*a*. Similarly, the ground electrode 4 has a noble metal chip 6 welded to an inner surface thereof to define a spark gap 7 between the noble metal chips 5 and 6. In use, the center electrode 3 is usually placed at a potential higher than the ground electrode 4, but in some cases at lower than the ground electrode 4. In any case, the center electrode 3 and the ground electrode 4 are placed to have a given potential difference therebetween.

The center electrode 3 is connected electrically at an upper end to a center stem 8 and a terminal 9. In use of the spark plug 100, the terminal 9 is to be connected to an external high-voltage supply circuit. A gasket 10 is attached to an outer periphery of the housing 1 above the thread 1*a*, as viewed in the drawing.

Figure 1:
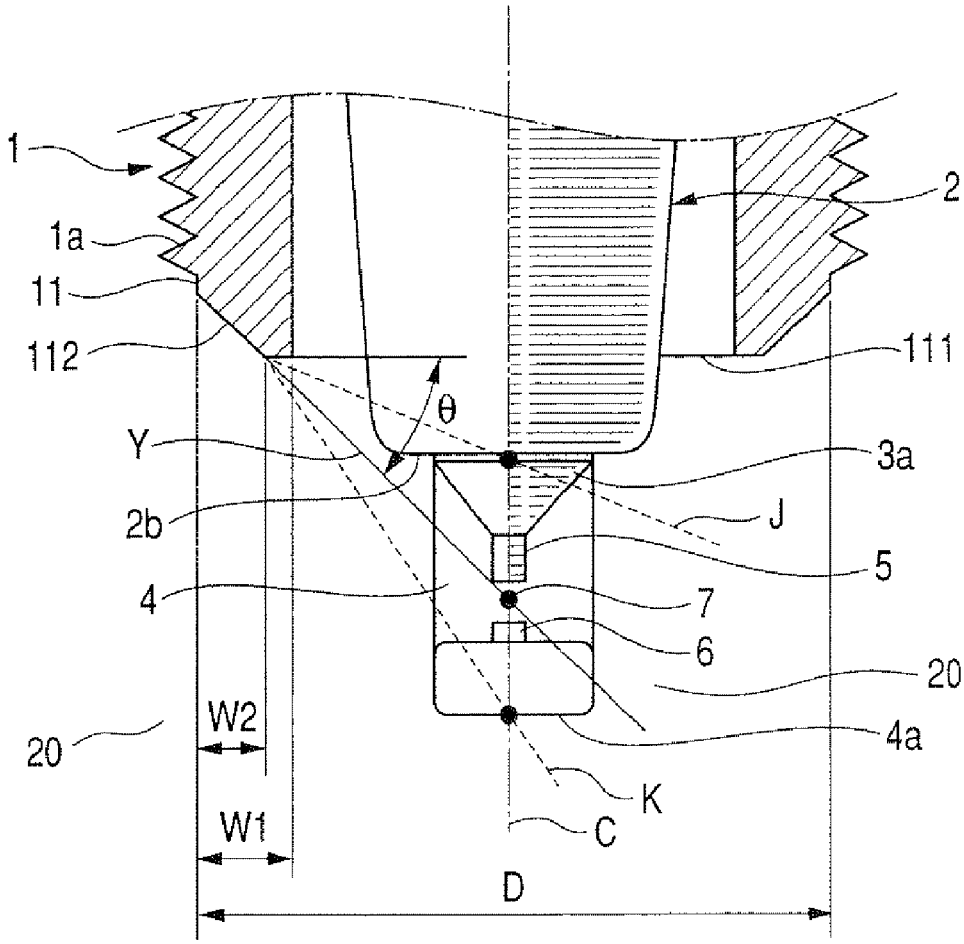
FIG. 1 is a partially enlarged sectional view which illustrates a top portion of a spark plug according to the first embodiment of the invention.

FIG. 1 is an enlarged sectional view which illustrates a top portion of the spark plug 100. The spark plug 100 is preferably designed to have the top surface 2*b* of the porcelain insulator 2 protruding outside an annular top surface 111 of the top end 11 of the metal shell 1 within a combustion chamber 20 of a cylinder of the internal combustion engine (not shown) when the spark plug 100 is installed in the engine.

The metal shell 1 is equipped with a stream shaper formed on the top end 11. Specifically, the top end of the metal shell 1 has an annular tapered surface 112 formed on an outer peripheral wall thereof as the stream shaper. The tapered surface 112 extends over the whole circumference of the top end 11 of the metal shell 1 to have an outer diameter D of the metal shell 1 which decreases toward the top surface 111 of the top end 11. In other words, the surface 112 is so shaped to taper to the top end 11 as to have an angle θ which a line Y extending along, that is, tangent to the tapered surface 112 at an intersection between the tapered surface 12 and the top surface 111 of the top end 11 makes with a plane, as defined to extend over the top surface 111, and lies in a range of 10° to 60°. The width W2 of a portion of the top end 11 defining the tapered surface 112, that is, the distance between an outside edge and an inside edge of the tapered surface 112 in a lateral direction perpendicular to the length of the spark plug 100 is 0.5 mm or more. A ratio of the width W2 to the width W1 of the top end 11, in other words, a wall thickness of the top surface 111 (i.e., W2/W1) is in a range of 0.5 to 1.0.

Figure 2:
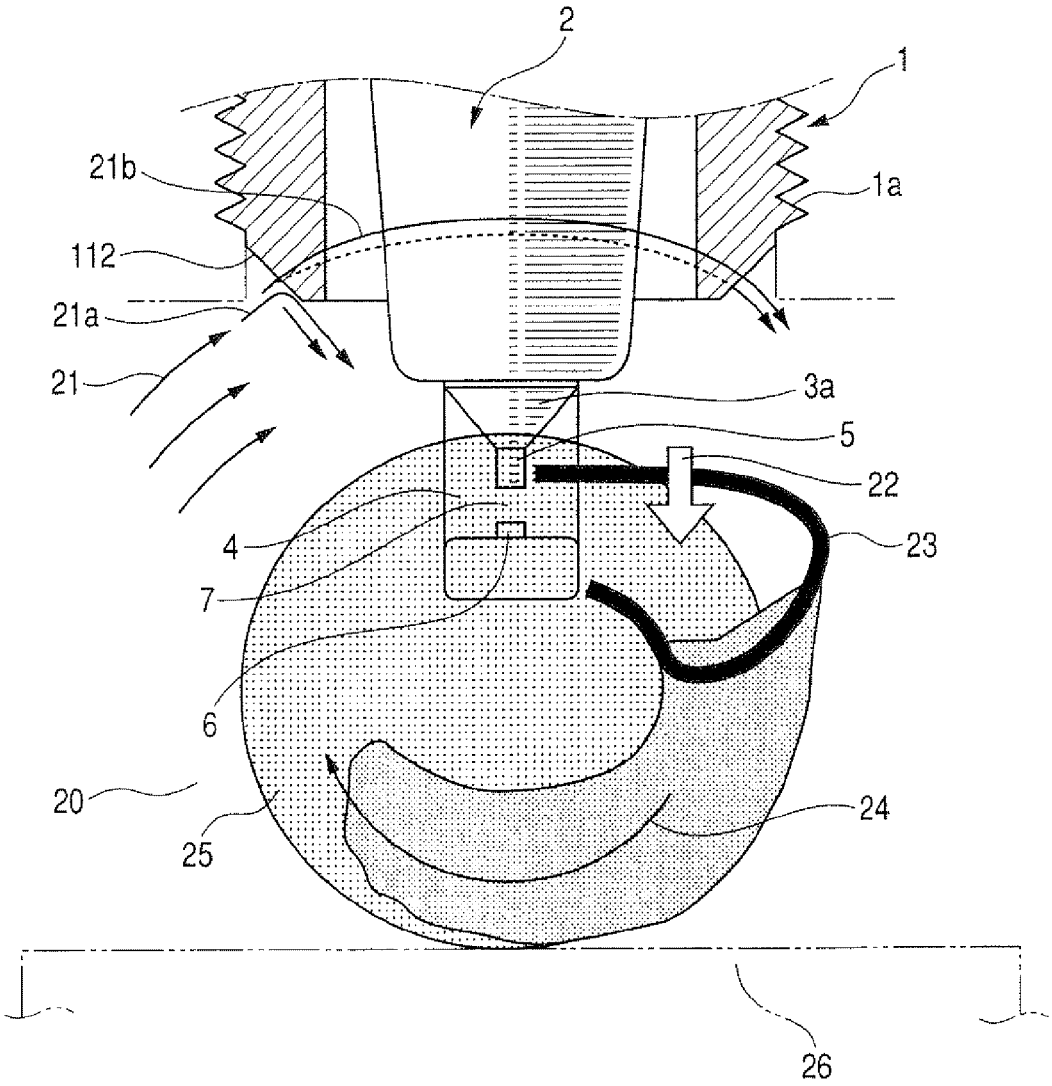
FIG. 2 is a schematic view which illustrates an operation of a stream shaper provided on the spark plug of FIG. 1 within a combustion chamber of an internal combustion engine.

The operation of the spark plug 100 will be described below with reference to FIG. 2.

An upward movement of the piston 26 usually results in formation of tumble vortexes 21 of air-fuel mixture, as indicated by black arrows in the drawing, within the combustion chamber 20. The tapered surface 112 of the end portion 11 of the meta shell 1 serves as the stream shaper to shape the tumble vortexes 21 into two vortex streams: mixture steams 21*a* which are reflected on an upstream portion (i.e., a left portion, as viewed in the drawing) of the tapered surface 112 and oriented to the spark gap 7 and mixture streams 21*b* that are remainders of the tumble vortexes 21 and flow, as clearly illustrated in the drawing, around the periphery of the porcelain insulator 2. Specifically, the mixture steams 21*b* advance along paths extending from the upstream portion to a downstream portion of the tapered surface 112 around the periphery of the porcelain insulator 2 and then are gathered and directed toward the center of the combustion chamber 20, as indicated by a white arrow 22, uniformly. The tumble vortexes 21 are, as is well known in the art, turbulences of air/fuel mixture which are generated in the early stage of the compression stroke or upward movement of the piston 26 within the combustion chamber 20, stream upward while rotating vertically, as viewed in the drawing, and pass through the width of the ground electrode 4. The tumble vortexes 21 typically turn, as indicated by the arrows 21, within the combustion chamber 20 regardless of the location of the ground electrode 4 within the combustion chamber 20. The center of the combustion chamber 20, as referred to herein, is the center of a volume in the combustion chamber 20 during the upward movement or compression stroke of the piston 26.

The tapered surface 112, as described above, works to change the tumble vortexes 21 into the two groups: the mixture streams 21*a* oriented toward the spark gap 7 and the mixture streams 21*b* oriented to the center of the combustion chamber 20, thereby directing or forcing a flow of sparks 23, as discharged between the chip 5 of the center electrode 3 and the chip 6 of the ground electrode 4, deep toward the center of the combustion chamber 20, that is, in the same direction as the mixture streams 21*b* stably.

The stable flow of the spark 23 oriented to the center of the combustion chamber 20 ensures quick and stable ignition of the air-fuel mixture within the combustion chamber 20 and enhances a flow of flame, as indicated by an arrow 24, to form a flame ball 24. The tapered surface 112, thus, serves to enhance the ability of the spark plug 100 to ignite the air-fuel mixture in the combustion chamber 20 and is effective, especially in low fuel ignitability conditions such as lean burning.

The angle θ which the line Y tangent to the tapered surface 112 makes with the plane, as defined to extend over the top surface 111, is, as described above, selected to be between 10° to 60°, but has been found experimentally to be preferably determined so that the line Y lies between a line J and a line K. The line J is a line extending from an interface between the tapered surface 112 and the top surface 111 to an intersection between the longitudinal center line C (i.e., an axial center line) of the spark plug 100 (i.e., the metal shell 1) and a plane extending on the top end surface 2*b* of the porcelain insulator 2 (i.e., an interface between the top end surface 2*b* and a top portion 3*a* of the center electrode 3 exposed outside the porcelain insulator 2). The line K is a line extending from the interface between the tapered surface 112 and the top surface 111 to an intersection between the longitudinal center line C of the metal shell 1 and a top end surface 4*a* of the ground electrode 4. The angle θ has been also found experimentally to be more preferably determined so that the line Y passes through the spark gap 7. It has been experimentally found that when the angle θ is less than 10° or more than 60°, the above described advantages of the spark plug 100 will be small.

FIGS. 3 to 6 illustrate modifications of the spark plug 100.

Figure 3:
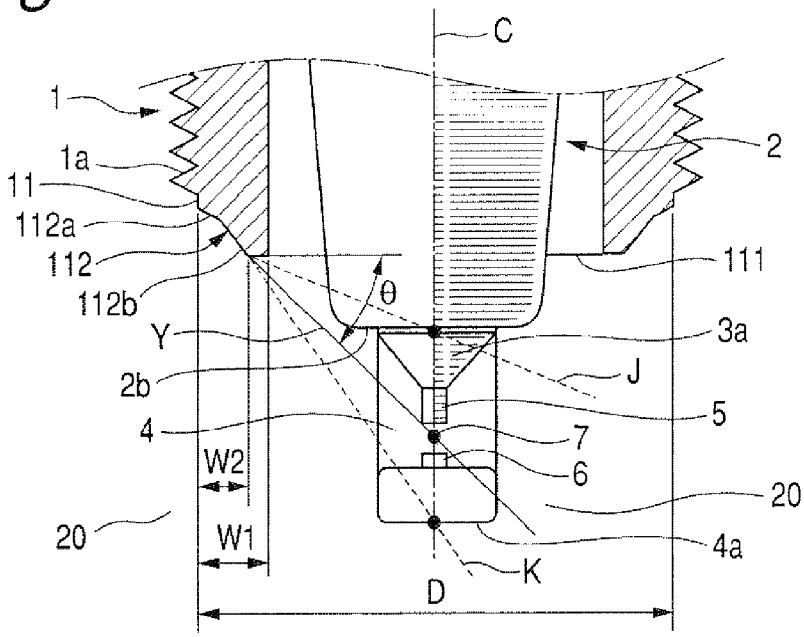
FIG. 3 is a partially enlarged sectional view which illustrates a first modification of the spark plug of FIG. 1.

In FIG. 3, the tapered surface 112 of the top end 11 of the metal shell 1 is made up of two annular surfaces 112*a* and 112*b* which are different in inclination to the length (i.e., the longitudinal center line C) of the metal shell 1 from each other. The inclination of an inner one of the annular surfaces 112*a* and 112*b* (i.e., the inner surface 112*b*) to the longitudinal center line C is preferably smaller than that of an outer one of the annular surfaces 112*a* and 112*b* (i.e., the annular surface 112*a*).

Each of the annular slant surfaces 112*a* and 112*b* extends over the whole circumference of the top end 11 of the metal shell 1. The tapered surface 112, like the first embodiment, has the outer diameter D which decreases from an outer edge of the slant surface 112*a* to an inner edge of the slant surface 112*b*.

The angle θ which the line Y tangent to an inner one of the slant surfaces 112*a* and 112*b* (i.e., the slant surface 112*b*) at an intersection between the inner one and the top surface 111 of the top end 11 makes with the plane, as defined to extend over the top surface 111, is selected to be between 10° to 60°, and preferably selected so that the line Y lies between the line J and the line K. The line J is a line extending from an interface between the slant surface 112*b* and the top surface 111 to the intersection between the longitudinal center line C of the metal shell 1 and the plane extending on the top end surface 2*b* of the porcelain insulator 2. The line K is a line extending from the interface between the slant surface 112*b* and the top surface 111 to the intersection between the longitudinal center line C of the metal shell 1 and the top end surface 4*a* of the ground electrode 4. The angle θ has been also found experimentally to be more preferably selected so that the line Y passes through the spark gap 7. It has been experimentally found that when the angle θ is less than 10° or more than 60°, the above described advantages of the spark plug 100 will be small. The tapered surface 112 may also be made up of three or more annular slant surfaces which are different in inclination to the longitudinal center line C of the metal shell 1 from each other. The slant surfaces 112*a* and 112*b* are preferably shaped to have the inclinations decreasing from outside to inside the metal shell 1. In other words, the tapered surface 112 is preferably shaped as a whole to have a radius of curvature to the center, as defined outside the metal shell 1.

Other arrangements are identical with those in the structure of FIG. 1, and explanation thereof in detail will be omitted here.

Figure 4:
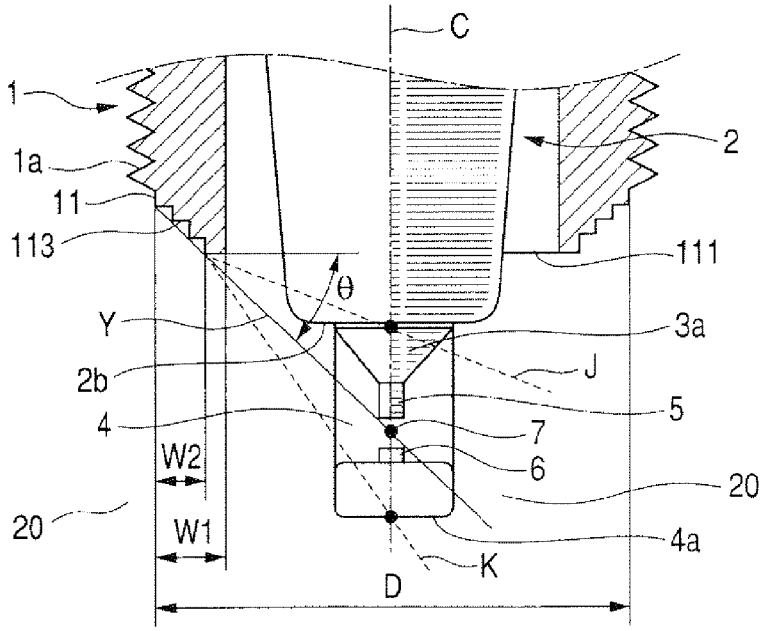
FIG. 4 is a partially enlarged sectional view which illustrates a second modification of the spark plug of FIG. 1.

In FIG. 4, the top end 11 of the metal shell 1 has a plurality of horizontal annular shoulder surfaces 113 formed stepwise on the outer peripheral wall thereof as the stream shaper. Each of the annular shoulder surfaces 113 extends over the whole circumference of the top end 11 of the metal shell 1 substantially at right angles to the longitudinal center line C. The outer diameter D of the metal shell 1 decreases stepwise from an outer edge of an outermost one of the shoulder surfaces 113 to an inner edge of an innermost one of the shoulder surfaces 113.

The angle θ which the line Y tangent to the shoulder surfaces 113, that is, extending through outer corners of the shoulder surfaces 113 makes with the plane, as defined to extend over the top surface 111, is selected to be between 10° to 60°, and preferably selected so that the line Y lies between the line J and the line K The line J is a line extending from an outer edge of the top surface 111 to the intersection between the longitudinal center line C of the metal shell 1 and the plane extending on the top end surface 2*b* of the porcelain insulator 2. The line K is a line extending from the outer edge of the top surface 111 to the intersection between the longitudinal center line C of the metal shell 1 and the top end surface 4*a* of the ground electrode 4. The angle θ has been also found experimentally to be more preferably selected so that the line Y passes through the spark gap 7. It has been experimentally found that when the angle θ is less than 10° or more than 60°, the above described advantages of the spark plug 100 will be small.

The top end 11 of the metal shell 1 may alternatively be shaped to have a single annular shoulder surface as the stream shaper.

Each of the annular shoulder surfaces 113 may be slant at an angle other than 90° to the longitudinal center line C.

Figure 5:
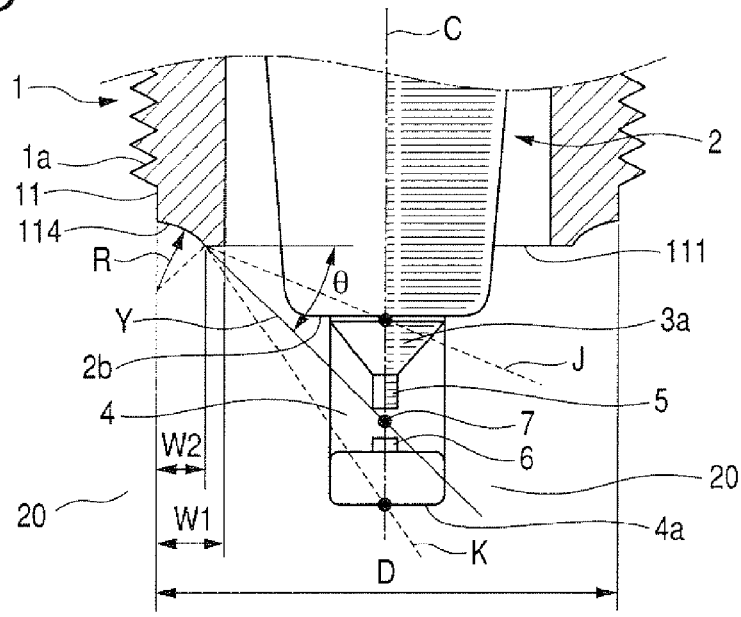
FIG. 5 is a partially enlarged sectional view which illustrates a third modification of the spark plug of FIG. 1.

In FIG. 5, the top end 11 of the metal shell 1 has an annular curved surface 114 formed on the outer peripheral wall thereof as the stream shaper. The curved surface 114 extends over the whole circumference of the top end 11 of the metal shell 1 and is shaped to have an arc in a longitudinal cross section of the metal shell 1 which has a radius R centered at a point defined outside the metal shell 1. The curved surface 114 is even, thus enhancing the control and shaping of the tumble vortexes 21.

The center of the radius R may be defined to shape the curved surface 114 so that a rate at which the outer diameter D of the metal shell 1 decreases from an outer edge to an inner edge of the curved surface 114 decreases. Conversely, the center of the radius R may be defined to shape the curved surface 114 so that the rate at which the outer diameter D of the metal shell 1 decreases from the inner edge to the outer edge of the curved surface 114 increases.

The angle θ which the line Y tangent to the curved surface 114 at an intersection thereof with the top surface 111 of the top end 11 makes with the plane, as defined to extend over the top surface 111, is selected to be between 10° to 60°, and preferably selected so that the line Y lies between the line J and the line K The line J is a line extending from an outer edge of the top surface 111 (i.e., the inner edge of the curved surface 114) to the intersection between the longitudinal center line C of the metal shell 1 and the plane extending on the top end surface 2*b* of the porcelain insulator 2. The line K is a line extending from the outer edge of the top surface 111 to the intersection between the longitudinal center line C of the metal shell 1 and the top end surface 4*a* of the ground electrode 4. The angle θ has been also found experimentally to be more preferably selected so that the line Y passes through the spark gap 7. It has been experimentally found that when the angle θ is less than 10° or more than 60°, the above described advantages of the spark plug 100 will be small.

Other arrangements are identical with those in the structure of FIG. 1, and explanation thereof in detail will be omitted here.

Figure 6:
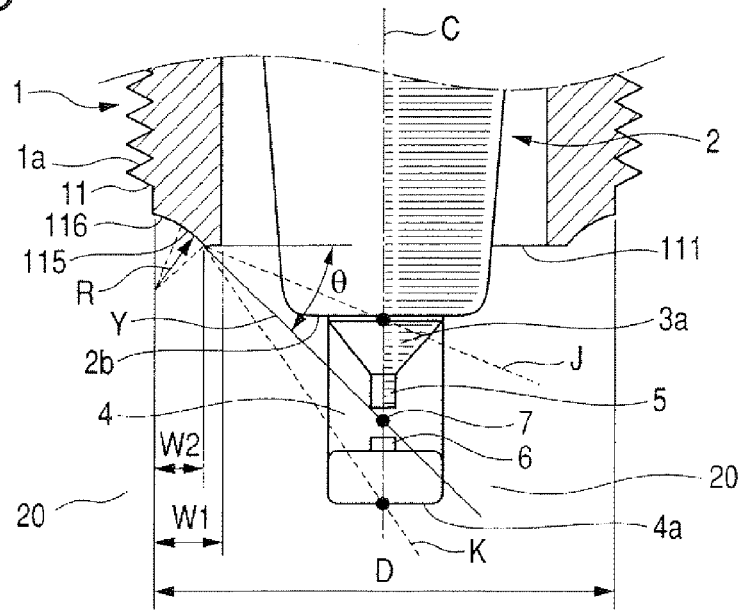
FIG. 6 is a partially enlarged sectional view which illustrates a fourth modification of the spark plug of FIG. 1.

The structure of the metal shell 1 in FIG. 6 is a combination of those in FIGS. 3 and 5. Specifically, the stream shaper defined by the outer peripheral wall of the top end 11 of the metal shell 1 is made up of two surfaces: an inner annular curved surface 115 and an outer annular slant surface 116 which is flat. Each of the curved surface 115 and the slant surface 116 extends over the whole circumference of the top end 11 of the metal shell 1. The curved surface 115 is shaped to have an arc in a longitudinal cross section of the metal shell 1 which has the radius R centered at a point defined outside the metal shell 1. The curved surface 115 is even, thus enhancing the control and shaping of the tumble vortexes 21.

The center of the radius R may be defined to shape the curved surface 115 so that a rate at which the outer diameter D of the metal shell 1 decreases from an outer edge to an inner edge of the curved surface 115 decreases. Conversely, the center of the radius R may be defined to shape the curved surface 115 so that the rate at which the outer diameter D of the metal shell 1 decreases from the inner edge to the outer edge of the curved surface 114 increases.

The angle θ which the line Y tangent to the curved surface 115 at an intersection thereof with the top surface 111 of the top end 11 makes with the plane, as defined to extend over the top surface 111, is selected to be between 10° to 60°, and preferably selected so that the line Y lies between the line J and the line K. The line J is a line extending from an outer edge of the top surface 111 (i.e., the inner edge of the curved surface 115) to the intersection between the longitudinal center line C of the metal shell 1 and the plane extending on the top end surface 2*b* of the porcelain insulator 2. The line K is a line extending from the outer edge of the top surface 111 to the intersection between the longitudinal center line C of the metal shell 1 and the top end surface 4*a* of the ground electrode 4. The angle θ has been also found experimentally to be more preferably selected so that the line Y passes through the spark gap 7. It has been experimentally found that when the angle θ is less than 10° or more than 60°, the above described advantages of the spark plug 100 will be small.

The curvature of the curved surface 115 enhances the control and shaping of the tumble vortexes 21 of the air-fuel mixture to ensure the stability of ignition thereof.

Figure 7:
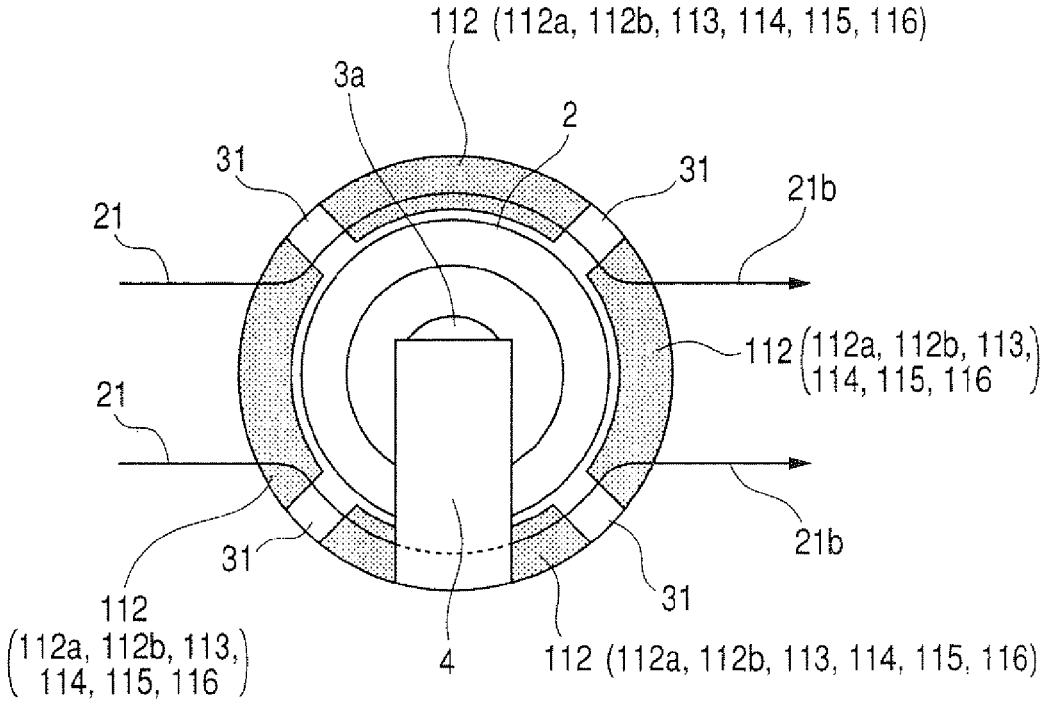
FIG. 7 is a partially enlarged sectional view which illustrates a fifth modification of the spark plugs of FIGS. 1 to 6.

The tapered surface 112 in FIG. 1, the slant surfaces 112*a* and 112*b* in FIG. 3, the shoulder surfaces 113 in FIG. 4, the curved surface 114 in FIG. 5, and the curved surface 115 and the slant surface 116 in FIG. 6 may alternatively be shaped to occupy 50% or more of the whole circumference of the top end 11 of the metal shell 1. For example, the top end of the metal shell 1, as illustrated in FIG. 7, has a plurality of flat recesses 31 to divide each of the tapered surface 112, the slant surfaces 112*a* and 112*b*, the shoulder surfaces 113, the curved surface 114, the curved surface 115, and the slant surface 116 into a plurality of sections which define paths along which the tumble vortexes 21 are shaped into the mixture streams 21*a* and 21*b*.

The noble metal chip 5 of the center electrode 3 may be shaped to have a diameter of 0.3 mm to 2.5 mm. The distance between the noble metal chip 5 and the noble metal chip 6 of the ground electrode 4, that is, the spark gap 7 may be selected to be 0.4 mm to 1.5 mm. Each of the noble metal chips 5 and 6 may be made of alloy containing a main component of at least one of Pt, Ir, and Rh and at least one of additives of Pt, Ir, Rh, Ni, W, Pd, Ru, Al, $Al_2O_3$, Y, and $Y_2O_3$.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug for an internal combustion engine, said spark plug comprising:

a hollow cylindrical metal housing which has an open top end portion to be exposed to a combustion chamber of an internal combustion engine;

a ground electrode of L-shape joined to said metal housing;

a center electrode disposed in said metal housing to define a spark gap between itself and a radially extending leg of said L-shaped ground electrode;

a porcelain insulator disposed in said metal housing to electrically insulate between said metal housing and said center electrode; and a stream shaper geometrically formed on an outer periphery of a top end portion of said metal housing to shape tumble vortexes of air-fuel mixture into vortex streams oriented toward a central portion of the combustion chamber, wherein said porcelain insulator has a nose protruding from a top surface of the top end portion of said metal housing;

wherein said stream shaper is defined by a portion of the outer periphery of said metal housing, the portion continuing to a top surface of the top end portion of the housing and being slanted towards a longitudinal center line of said metal housing to have an outer diameter of the top end portion of said metal housing which diameter decreases towards the top surface of the top end portion;

wherein an angle θ defined by (a) a line tangent to the slanted portion of the outer periphery of said metal housing at an intersection with the top surface of the top end portion of said metal housing and (b) a plane extending over the top surface of the top end portion lies in a range of 10° to 60° ; and wherein the slanted portion of the outer periphery of said metal housing is so shaped that the line tangent to the slanted portion passes through the spark gap.

2. A spark plug as set forth in claim 1, wherein the slanted portion of the outer periphery of the top end portion defining said stream shaper has a width W2 in a lateral or radial direction perpendicular to the longitudinal center line of said metal housing which is 0.5 mm or more, and a ratio of the width W2 to a width W1 of the top surface of the top end portion in the lateral or radial direction (W2/W1) is in a range of 0.5 to 1.0.

3. A spark plug as set forth in claim 1, wherein the slanted portion of the outer periphery of said metal housing defining said stream shaper has formed at least partially thereon a tapered surface along which the outer diameter of the top end portion decreases toward the top surface.

4. A spark plug as set forth in claim 1, wherein the slanted portion of the outer periphery of said metal housing defining said stream shaper has at least one stepwise shoulder surface formed thereon so that the outer diameter of the top end portion decreases stepwise toward the top surface.

5. A spark plug as set forth in claim 1, wherein the slanted portion of the outer periphery of said metal housing defining the stream shaper includes a curved surface.

6. A spark plug as set forth in claim 1, wherein the slanted portion of the outer periphery of said metal housing defining the stream shaper includes a surface which is so curved that a rate at which the inner diameter of the top end portion decreases toward the top surface of the top end portion decreases toward the top surface.

7. A spark plug as set forth in claim 1, wherein the slanted portion of the outer periphery of said metal housing defining the stream shaper includes a surface which is so curved that a rate at which the inner diameter of the top end portion decreases toward the top surface of the top end portion increases toward the top surface.

8. A spark plug as set forth in claim 1, wherein the stream shaper occupies 50% or more of the top end portion of said metal housing.

* * * * *